US005450913A

United States Patent [19]

Mefferd et al.

[11] Patent Number: 5,450,913

[45] Date of Patent: Sep. 19, 1995

[54] CONTINUOUS SOIL SAMPLING SYSTEM AND METHOD

[75] Inventors: Larry C. Mefferd; Floyd R. Mefferd, both of Laurens, Iowa

[73] Assignee: Gold Star Manufacturing, Inc., Laurens, Iowa

[21] Appl. No.: 130,665

[22] Filed: Oct. 1, 1993

[51] Int. Cl.[6] ..... E21B 49/02

[52] U.S. Cl. ..... 175/58; 175/236; 175/246

[58] Field of Search ..... 175/236, 246, 257, 58; 294/86.27, 86.31, 86.32, 86.33

[56] References Cited

U.S. PATENT DOCUMENTS

| | | | |
|---|---|---|---|
| 2,080,978 | 5/1937 | Church | 175/58 X |
| 2,300,016 | 10/1942 | Scott et al. | 175/236 X |
| 2,954,258 | 9/1960 | Cook | 294/86.31 |
| 3,095,051 | 6/1963 | Robinsky et al. | 175/236 X |
| 3,241,624 | 3/1966 | Rassieur | 175/246 X |
| 3,346,059 | 10/1967 | Svendsen | 175/246 |
| 3,794,127 | 2/1974 | Davis | 175/58 |
| 4,081,040 | 3/1978 | Henson | 175/58 |
| 4,825,963 | 5/1989 | Ruhle | 175/236 X |
| 5,206,505 | 4/1993 | Sprunt | 175/249 X |
| 5,269,572 | 12/1993 | Mefferd | 285/300 |

*Primary Examiner*—Hoang C. Dang

*Attorney, Agent, or Firm*—Zarley, McKee, Thomte, Voorhees & Sease

[57] ABSTRACT

The invention provides an apparatus and method for taking samples of soil and other materials in an efficient manner as well as for maintaining a high level of integrity of the samples. Using a wire line and a release and retrieve assembly, the sampling tube is lowered into an auger that has been bored into the ground to the desired depth. Once lowered to the bottom of the auger, the sampling tube is locked into place and the release and retrieve assembly is removed from the auger. A portion of the sampling tube extends beyond the drill bit. As the auger is drilled farther into the ground, the sampling tube is filled with soil or whatever material is present, without such soil or other material having been disturbed by the drill bit. This provides integrity of the sample. After the sample has been collected in the sampling tube, the release and retrieve assembly is reinserted into the auger and reattached to the sampling tube, which is then unlocked and retrieved out of the auger.

31 Claims, 7 Drawing Sheets

CONTINUOUS SOIL SAMPLING SYSTEM AND METHOD

BACKGROUND OF THE INVENTION

1. Field of the Invention

The invention relates to an apparatus and method for obtaining soil samples, and more particularly, to an apparatus utilizing a release and retrieve mechanism not requiring the repetitive and time consuming assembly and disassembly of sections of a center rod to obtain the soil samples, or for performing other tasks requiring an item to be lowered into a drill bore, released at the bottom of the bore, and then retrieved without assembling and disassembling sections of center rod.

2. Description of the Related Art

In the past, most soil sampling systems were used for geophysical applications (i.e., design and construction, oil and mineral exploration, etc.). These applications do not require stringent levels of integrity for the samples. More recently, soil sampling increasingly has been carried out for the purpose of environmental monitoring. For these applications, integrity of the samples is critical because it is desirable to obtain accurate analyses of small concentrations of contaminants at specific depths. Existing sampling methods are not entirely satisfactory for environmental monitoring purposes because they require the time-consuming assembly and disassembly of a center rod at every depth for which a sample is required.

In using existing soil sampling apparatus, after a well is drilled using a tube auger to a depth at which a sample is desired, a sampling tube must be inserted into the auger. This is accomplished through the use of a center rod. A center rod section adapted for taking samples (i.e., a sampling tube) is inserted first. Next, successive center rod sections, typically having a length of five feet, are added one by one to the top of the previous center rod sections and inserted into the auger. After each successive center rod section has been detachably attached to the top section of center rod in the auger (which can remain in the bore until the drilling is complete to the desired depth), the center rod is lowered farther into the auger and then held while another section is detachably attached to the top end of the previously added section. This process of adding center rod sections is repeated until enough sections have been added so that the sampling tube is at the bottom of the bore. The sample is then taken by pushing the sampling tube into the soil at the bottom of the bore.

After the sample is taken, the sampling tube containing the sample is removed from the bore by raising the entire center rod out of the auger and removing each section, one at a time. Thus, obtaining a soil sample by prior methods is a time-consuming process. When samples are needed from several depths, these difficulties are compounded. Thus, an apparatus for taking soil samples faster and more efficiently is desirable.

SUMMARY OF THE INVENTION

A primary object of the present invention is to provide an apparatus and method for taking soil samples faster and more efficiently.

A related object is to provide an apparatus for the faster and more efficient insertion and removal of accessories operating on the inside of well bores, tubes or augers.

Another related object is to provide an apparatus not requiring the time-consuming assembly and disassembly of a center rod to take soil samples, or to perform other tasks requiring a center rod.

Another object of the present invention is to reduce or eliminate contamination in the soil samples by using a liner inside the sampling tube.

The present invention accomplishes these and other objects through use of a release and retrieve assembly which eliminates the need for assembling and disassembling a center rod. The sampling tube or other accessory is coupled to a locking mechanism which is suspended from the release and retrieve assembly and is lowered into the auger using a wire line. When the sampling tube (or other accessory) bottoms out, the locking mechanism locks the sampling tube in position. The release and retrieve assembly is then released and removed. In the preferred embodiment, the sampling tube is placed so as to extend an adjustable distance ahead of the drill bit to aid in maintaining the integrity of the sample. The auger is then drilled farther down into the ground thereby filling the sampling tube. To retrieve the sampling tube, the release and retrieve assembly is lowered via a wire line into the well until it engages the locking mechanism and releases the sampling tube from the locked position in the auger tube. The sampling tube is then raised from the auger by the wire line.

Because no center rod assembly or disassembly is required, samples are taken more quickly and efficiently than is possible with existing center rod systems.

DETAILED DESCRIPTION OF THE PREFERRED EMBODIMENT

Figure 4:
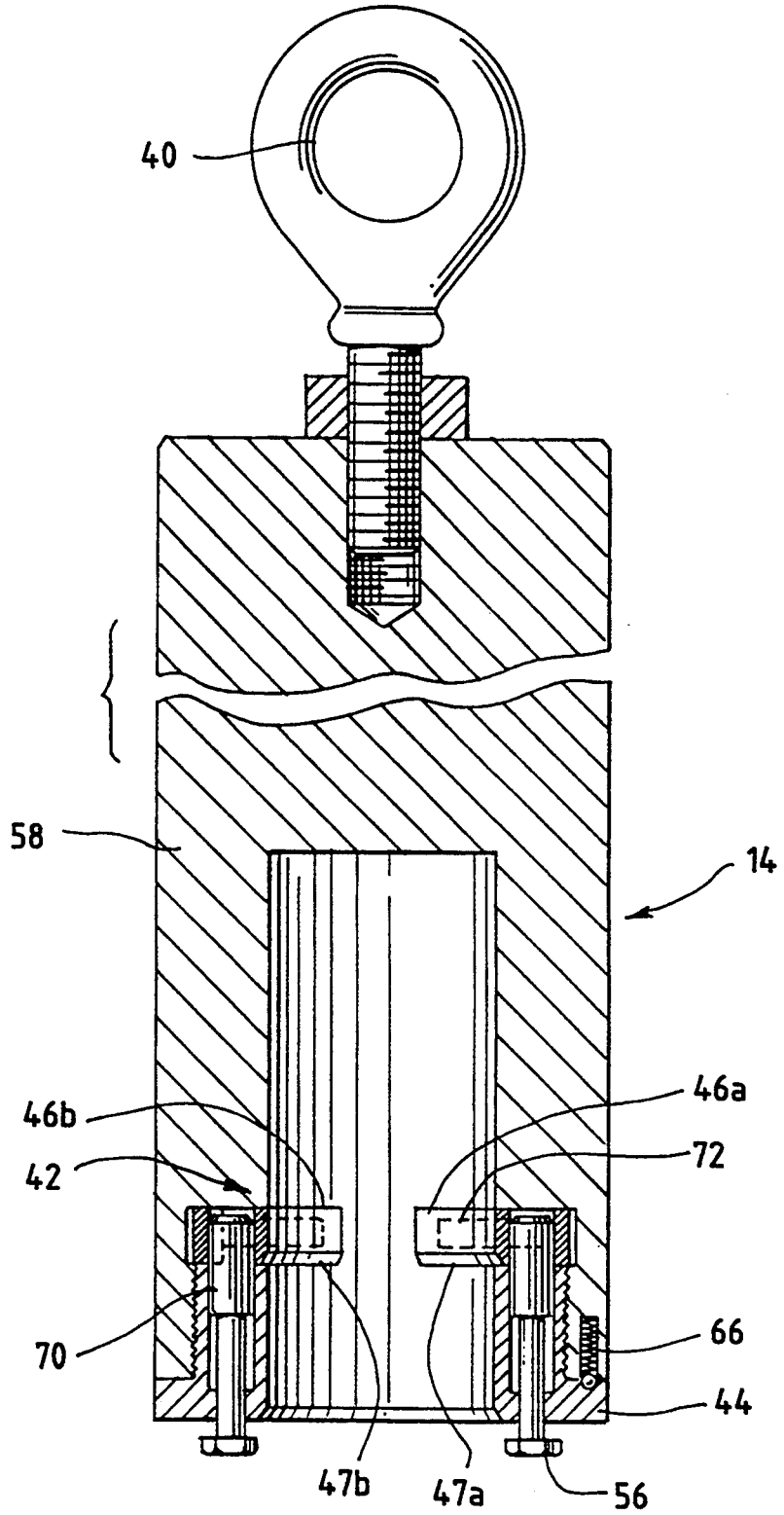
FIG. 4 is a cross-section view of a release and retrieve assembly.

The apparatus of the present invention comprises three main components: a sampling tube 10 (FIG. 2) (or other accessory to be operated at the bottom of a drill hole); a locking mechanism 2 (FIG. 1); and a release and retrieve assembly 14 (FIG. 4). These main components are used in conjunction with a tube auger that can be used for drilling environmental monitoring wells. It is to be understood that auger 28 is only one example of an application in which the present invention can be used. More generally, the invention can be used in any type of tube, not just an auger.

Figure 2:
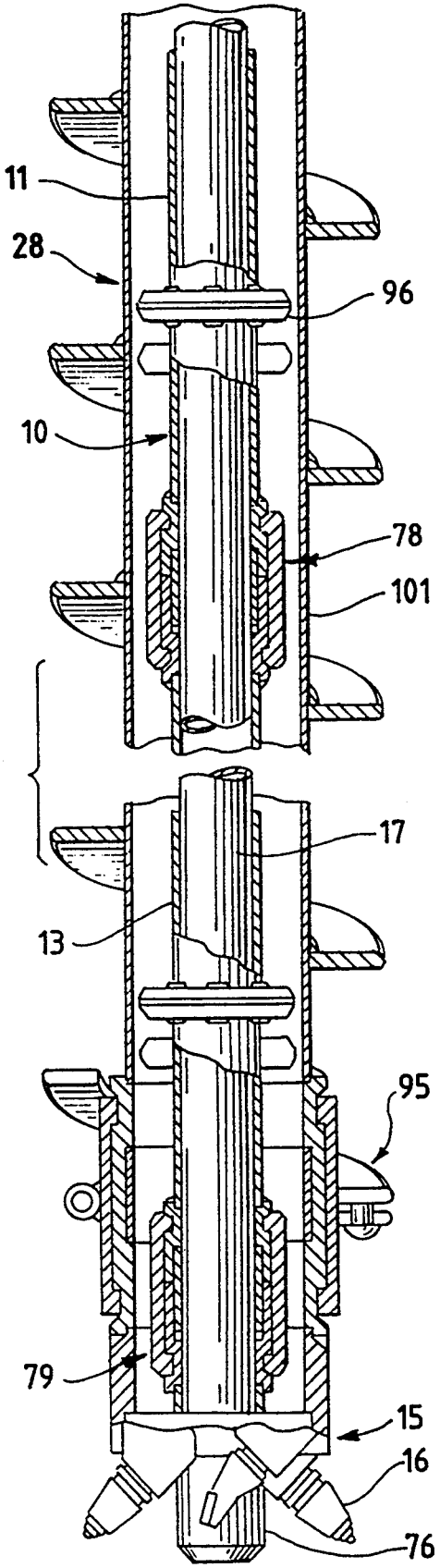
FIG. 2 is a cross-section view of the lower portion of an auger and sampling tube of the present invention.

Referring to FIG. 2, auger 28 comprises several portions including a housing 100 having a stopping shoulder 118 for receiving locking mechanism 12. Housing 100 fines an interior circumferential groove 30. Auger 28 also can include a pair of housing extensions 98 and 99. Upper housing extension 98 is welded to the top of housing 100 and lower housing extension 99 is welded to the bottom of housing 100. Lower housing extension 99 is connected on its opposite end to a standard auger section 101 via a split coupler assembly 94. Standard auger section 100 typically has a length of five feet. At the bottom of auger 28 is an auger bit assembly 15. Auger bit assembly 15 is connected to standard auger section via a split coupler assembly 95. Auger bit assembly 15 includes drill bits Sampling tube 10 actually collects and contains the sample of soil. Sampling tube 10 extends an adjustable distance beyond drill bits 16 of the auger 28. This protrusion beyond drill bits 16 helps to maintain the integrity of the sample by enabling the sample to be collected before the soil is disturbed by drill bits 16. An operator determines how far beyond drill bits 16 sampling tube 10 protrudes based on the characteristics of the soil or other material being sampled. In looser soil, it is desirable to extend sampling tube 10 farther ahead of drill bits 16. This additional protrusion of sampling tube 10 creates additional friction between sampling tube and the soil, thereby helping to prevent rotation of sampling tube 10 relative to the soil. If sampling tube 10 is allowed to rotate, the soil sample is not undisturbed.

In the preferred embodiment, a start tube is rigidly connected to the bottom of sampling tube 10 by a lower coupler 79. The lower exterior of start tube 76 is tapered from top to bottom to facilitate the entry of start tube 76 into the soil. Start tube reduces the possibility of damage to sampling tube if the apparatus reaches solid rock or other hard material. Start tube 76 absorbs most of the impact and, thus, start tube 76 is replaced rather than sampling tube 10.

The sampling tube 10 is preferably made of stainless steel or another non-corrosive material that can be decontaminated readily. Sampling tube can be made from two half cylinders so that it can be separated into two halves for easy access to the sample. In addition, sampling tube 10 can contain a liner 17 of a material such as Lexan TM polycarbonate resin or other suitable material for greater convenience and preservation of the integrity of the sample. After the sample is taken and retrieved, the liner simply is removed from sampling tube 10 and capped at both ends with suitable caps or plugs (not shown). The sealed liner can then be taken to a laboratory for analysis of the sample.

In order to increase the strength of sampling tube 10 and to prevent bowing of sampling tube 10, in the preferred embodiment, sampling tube 10 is made of two or more shorter portions joined by one or more couplers 78. Thus, in FIG. 2, coupler 78 joins an upper sampling tube section and a lower sampling tube section 13. It is to be understood that more than one coupler 78 and more than two sampling tube sections can be used to further strengthen sampling tube 10.

Figure 1:
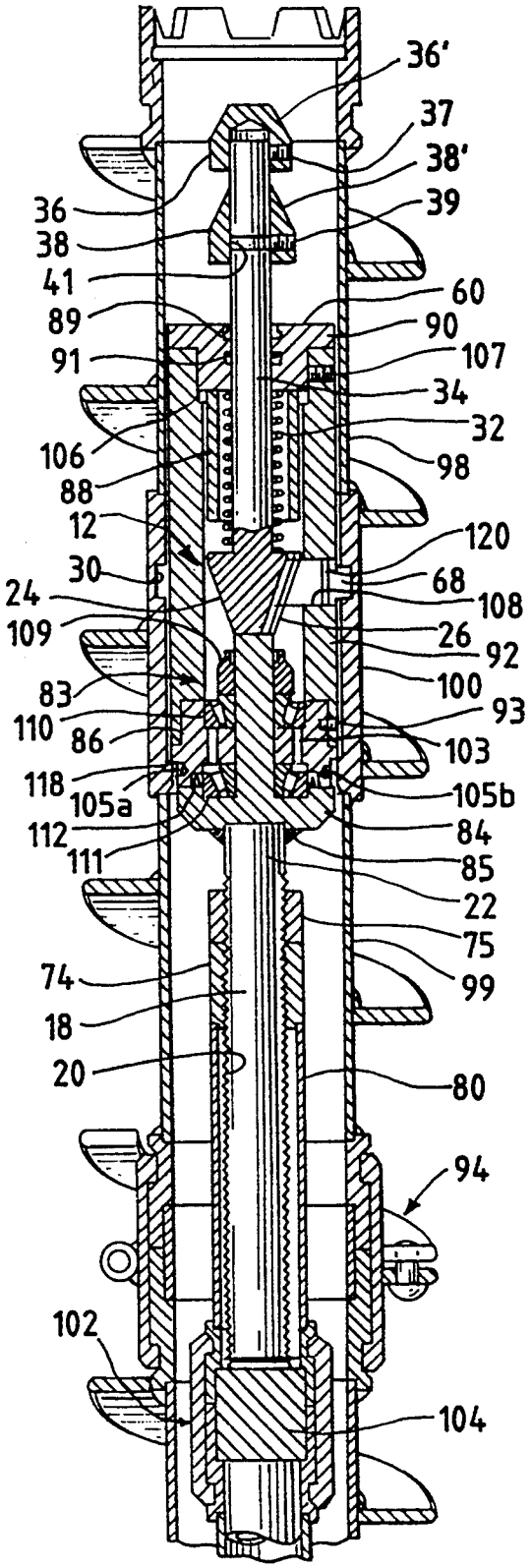
FIG. 1 is a cross-section view of the upper portion of an auger and sampling tube, as well as a locking mechanism of the present invention.

As shown in FIG. 1, the upper end of the sampling tube 10 is coupled via coupler 102 to an adjustment shaft 18 having threads 20 for controlling the length of the protrusion of sampling tube 10 and start tube 76.

An adjustment collar 74 is threaded onto adjustment shaft 18. Adjustment collar 74 abuts an adjustment collar tube 80. Adjustment collar 74 is threaded an appropriate length down adjustment shaft 18 thereby moving adjustment collar tube 80, sampling tube 10 and start tube 76 so that start tube 76 is placed at its desired protrusion beyond drill bits 16. A locking nut 75 prevents adjustment collar 74 from unthreading from adjustment shaft 18. The top portion 22 of adjustment shaft 18 is rigidly attached to a connector 84 by a weld 85 or other suitable means.

Figure 10:
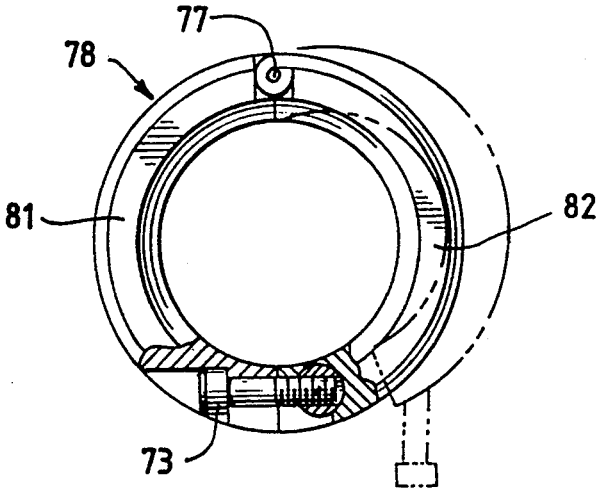
FIG. 10 is a perspective view of a coupler used in the present invention.

Referring now to FIG. 1, a split coupler assembly 94 connects two auger sections when auger consists of more than one section. Split coupler assemblies 94 and 95 are of the type disclosed in U.S. Pat. No. 5,269,572 entitled "Apparatus and Method for Coupling Elongated Members." Couplers 78, 79 and 102 are similar to, but smaller than, split coupler assembly 94. Coupler 102 includes a plug 104 to keep the soil sample within sampling tube 10. As shown in FIG. 10, coupler 78 includes two split cylindrical clamps 8 and 82 held together by a hinge 77. Coupler 78 differs from the coupler disclosed in the referenced application in that it is locked together by a pair of cap screws 73.

Pairs of semi-circular sampling tube stabilizers 96 can be placed intermittently about sampling tube 10. Each pair of sampling tube stabilizers 96 can start as a single machined ring that is then cut in half. Pairs of stabilizers 96 can be placed about ½ inch apart from each other.

Figure 6:
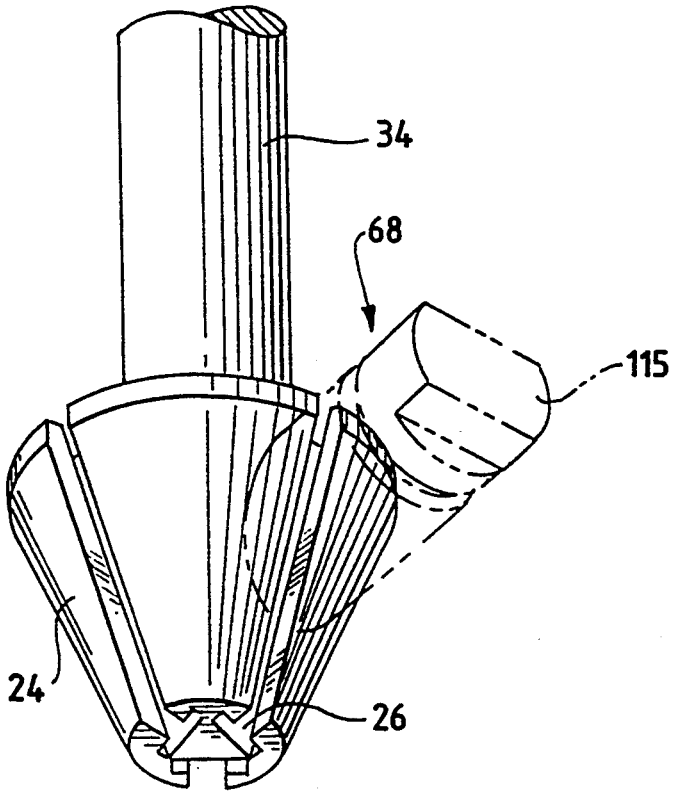
FIG. 6 is a perspective view of a T-pin guide of the present invention showing in phantom a T-pin of the present invention.

Locking mechanism 12 includes a pin guide 24 having one or more guide slots 26. In the preferred embodiment, pin guide 24 has three guide slots 26 spaced 120° apart. As shown in FIG. 6, guide slots 26 are "T-shaped." Guide slots 26 span the length of pin guide 24 and are parallel to the outer surface of pin guide 24.

Figure 7:
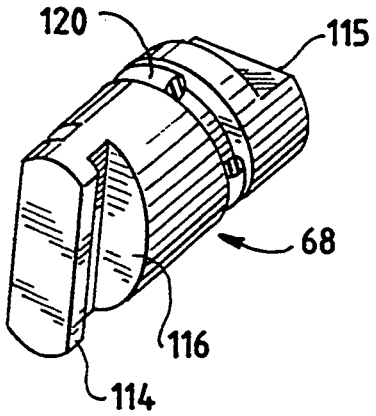
FIG. 7 is a perspective view of a T-pin of the present invention used in connection with the T-pin guide of FIG. 6.

Inside guide slots 26 are locking pins 68 which lock sampling tube 10 in place within auger 28 when a sample is to be taken. As shown in FIG. 7, locking pins 68 have an interior portion 114 extending from a face 116. Interior portion 114 is angled (see also FIGS. 1 and 3) so as to reciprocatingly match with the angle of guide slots 26 so that an end portion of locking pin 68 extends in a radial direction toward annular groove 30 in auger 28. In the preferred embodiment, this angle is 21°. Locking pins 68 also include an O-ring 120, which prevents dirt from entering to the interior of locking mechanism Locking pins 68 extend into corresponding openings 108 in a body 92. Groove 30 in the interior of the inner wall of housing 100 receives locking pins 68 when pins 68 are positioned near the large diameter end of pin guide 24. As shown in FIG. 7, locking pins 68 are preferably T-pins that fit in guide slots 26 of pin guide 24 shown in FIG. 6.

Figure 3:
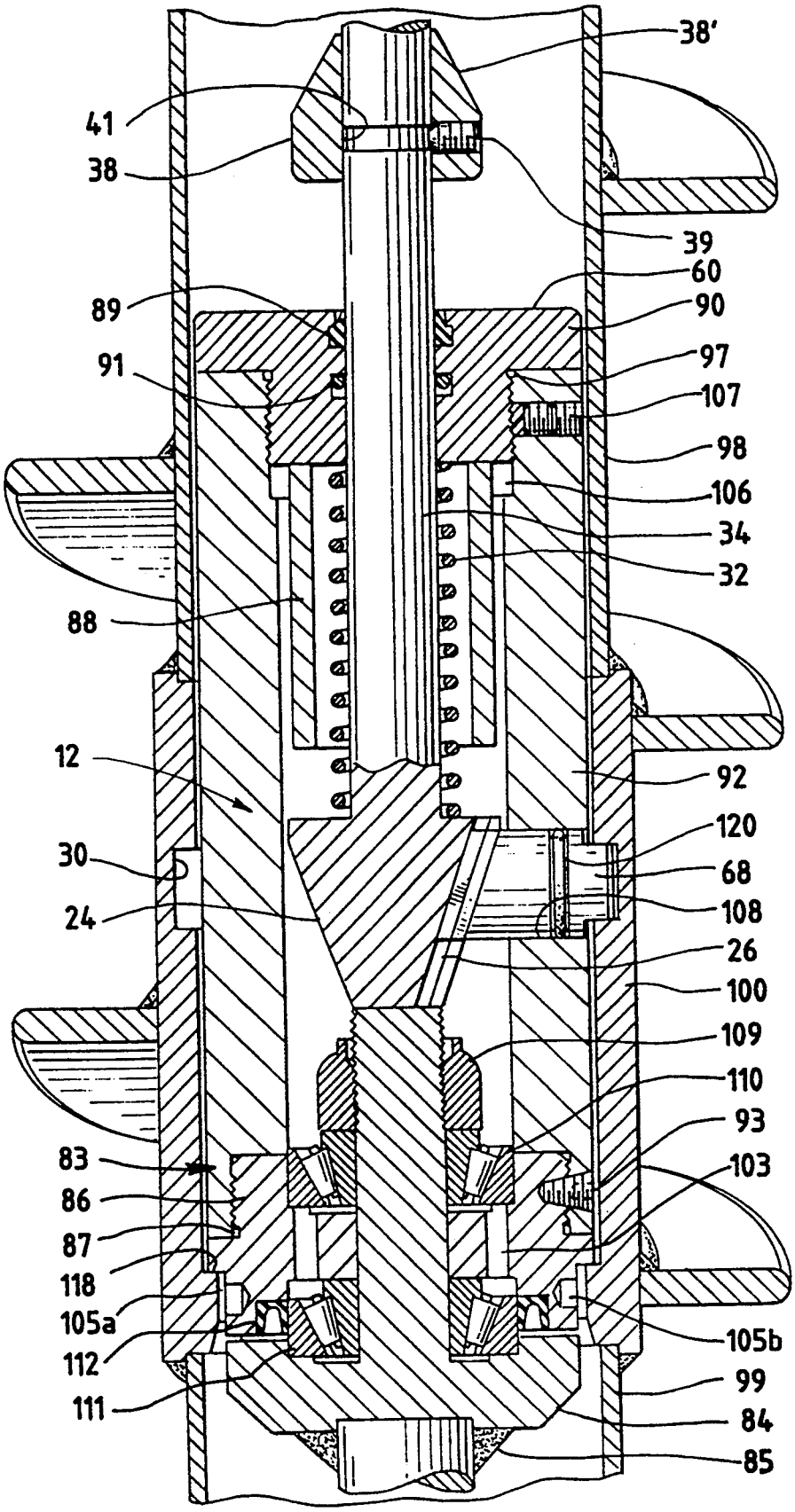
FIG. 3 is an enlarged cross-section view of a portion of the auger, locking mechanism and sampling tube.

Locking pins 68 slide in guide slots 26 with interior portion 114 of locking pins 68 being housed within pin guide 24. The distance that locking pins 68 extend into openings 108 of body 92 and groove 30 in auger 28 depends on the relative vertical position of pin guide 24 with respect to openings 108. If the larger diameter, upper portion of pin guide 24 is level with openings 108, locking pins 68 extend all the way through openings 108 and into groove 30 of housing 100. Conversely, when the smaller diameter, lower portion of pin guide 24 is level with openings 108, locking pins 68 extend only into openings 108 and not into groove 30 of housing 100. This difference is due to the fact 10 that locking pins 68 are maintained in guide slots 26 which are parallel to the outer surface of pin guide 24, as shown in FIGS. 3 and 6.

Connector 84 limits the downward vertical movement of pin guide 24. Connector 84 is externally threaded on one end to receive an elastic lock nut 109. In the preferred embodiment, connector 84 also is engaged by a bearing assembly 83. Bearing assembly 83 includes a bearing housing 86 and roller bearings and 111. Bearing housing 86 is threaded into the lower end of body 92. Spanner holes 105*a*, 105*b* facilitate tightening of bearing housing 86 into body 92. A set screw 93 locks body 92 and bearing housing 86 together. An O-ring 87 fits between bearing housing 86 and body 92. A pair of holes 103 allows the bearing race to be removed during disassembly.

Bearing housing 86 houses roller bearings and 111. Roller bearings 110 and 111 prevent rotational movement of connector 84 while body 92 rotates with auger 28. Because connector 84 does not rotate, sampling tube 10 does not rotate. Roller bearings 110 and 111 alternatively can be thrust bearings. A seal 112 prevents soil and debris from entering into bearing housing 86.

Bearing assembly 83 can be omitted in applications in which it is acceptable or desirable for a central accessory to rotate. For example, rather than having a sampling tube 10 extending through the bore of auger 28, a center bit might be extended instead. Because rotation of the center bit is desired, connector 84 rotates with body 92. Therefore, bearing assembly 83 is not needed.

A shaft 34 extends axially away from pin guide 24 through a spring 32 and a lock cap 90. At end of shaft 34 opposite pin guide 24 are a lift head cone 36 and a release head cone 38. Lift head cone 36 and release head cone 38 are designed to be engaged by release and retrieve assembly 14. Release head cone has a slightly larger diameter at its widest portion than lift head cone 36 has at its widest portion. Release head cone 38 can define three equally spaced holes for receiving set screws 39. Release head cone 38 slides over shaft 34 such that set screws 39 are aligned with an annular groove 4 in shaft 34. Set screws 39 are tightened to hold release head cone 38 on shaft 34. Lift head cone 36 can be threaded onto the end of shaft 34 and held in place by a set screw 37 or other suitable means. Alternatively, lift head cone and release head cone 38 can be an integral piece. The important factor in either embodiment is proper spacing between lift head cone 36 and release head cone 38 to allow engagement and release by release and retrieve assembly 14.

A cap 90 is threaded into body 92. Two set screws 107 also can be inserted to lock cap 90 and body 92 together. Cap 90 has a flat stopping wall 60 on its upper surface. Cap 90 includes two grooves to house a wiper 89 and an O-ring 91. Wiper 89 cleans shaft when shaft 34 moves vertically within wiper 89. O-ring 91 serves as a seal to keep soil and debris from entering the apparatus. Another O-ring 97 is housed between cap 90 and body 92.

Located between cap 90 and pin guide 24 is a cylindrical guide stop 88. Guide stop 88 contacts and limits axial movement of pin guide 24 when pin guide 24 is moved in an upward direction. A spacer 106 creates a friction fit between guide stop 88 and body 92, thereby holding guide stop 88 in position and preventing it from contacting spring 32.

Referring to FIG. 4, release and retrieve assembly 14 has an eyelet 40 for attachment to a wire line (not shown). The other end of the wire line is attached to a hoist (not shown) at the top of the well bore for raising and lowering release and retrieve assembly 14 within auger 28. Release and retrieve assembly 14 permits sampling tube 10 to be lowered within the hollow bore of auger 28 or tube, as well as to be retrieved from auger 28 after the sample has been taken. At the lower end of release and retrieve assembly 14 are a split ring 42 and a hold and release head 44, most clearly seen in FIGS. 5A and 5B.

Figure 5A:
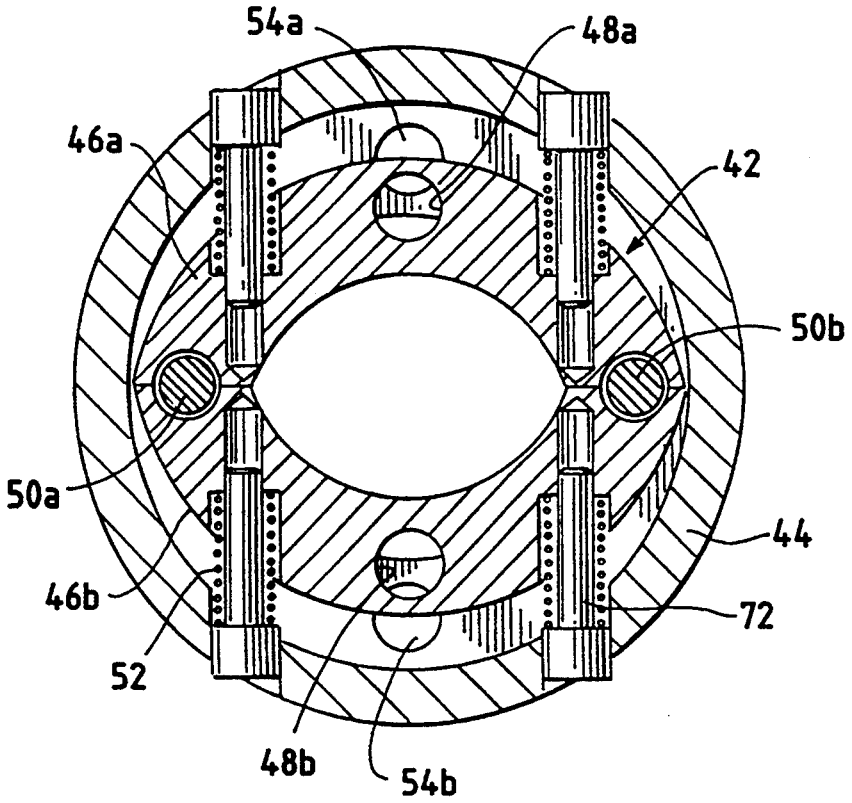
FIG. 5A is a cross-section view of a split ring and a hold and release head with the jaws of the split ring in their closed position.
Figure 5B:
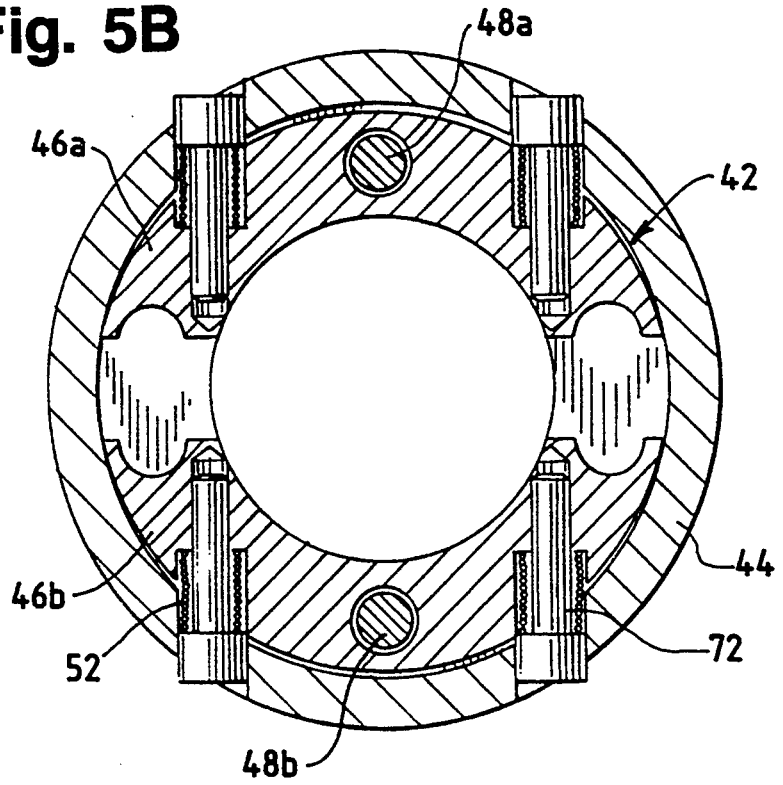
FIG. 5B is a cross-section view of a split ring and a hold and release head with the jaws of the split ring in their open position.

Split ring 42 comprises two jaws 46*a*, 46*b* that are adapted for movement between two rest positions—i.e., the closed position of FIG. 5A, or the open position of FIG. 5B. Jaws 46*a*, 46*b* define openings in their interiors to receive split ring guide pins 72 and jaw springs 52. Jaws 46*a*, 46*b* each have a tapered lower edge 47*a*, 47*b* to facilitate the passing of jaws 46*a*, 46*b* over lift head cone 36 and release head cone 38. Jaws 46*a*, 46*b* move away from each other (i.e., toward the open position) as they slide down the conical portion 36' of lift head cone 36 and the conical portion 38' of release head cone 38. Jaws 46*a*, 46*b* define active holes 48*a*, 48*b* extending through their centers. Active holes 48*a*, 48*b* are "active" because they can be used to change the position of jaws 46*a*, 46*b* from closed to open as described below. When jaws 46*a*, 46*b* are in the closed position, two passive holes 50*a*, 50*b* are formed. Passive holes 50*a*, 50*b* are "passive" because they have no effect on the positioning of jaws 46*a*, 46*b*. Jaw springs 52 surround split ring guide pins 72 and pass through the interior of jaws 46*a*, 46*b*. By means of jaw springs 52, jaws 46*a*, 46*b* of split ring 42 are spring-biased toward the closed position of FIG. 5A.

Hold and release head 44 includes two pin openings 54*a*, 54*b* for maintaining two pins 56 in a position perpendicular to the bottom face of hold and release head 44. Each of pins 56 is threaded into a larger split ring lock pin 70. Split ring lock pins 70 prevent pins 56 from falling out of the bottom of hold and release head 44 because split ring lock pins 70 have a larger diameter than the lower portion of the opening that accommodates pins 56. After pin 56 is threaded into split ring lock pin 70, pin 56 and split ring lock pin 70 move as a unit within hold and release head 44. Pins 56 are movable between an extended position and an inserted position. Hold and release head 44 is threaded into a release and retrieve body 58 and is rotatable with respect to the rest of release and retrieve assembly 14, including split ring 42 and release and retrieve body 58. Release and retrieve body 58 defines a cavity 64 at its lower end to accommodate lift head cone 36 and release head cone 38.

Hold and release head 44 can be set in either of two positions that are 90° apart—(1) hold; or (2) release. A spring-biased detent mechanism 66 maintains hold and release head 44 in the selected position. In the hold position, pins 56 are aligned with passive holes 50*a*, 50*b*. As a result, when pins 56 contact stopping wall 60 and are inserted through passive holes 50*a*, 50 they have no effect on jaws 46a, 46b—i.e., jaws 46a, 46b are able to return to their spring-biased, closed position after opening up. If hold and release head 44 is set in the release position, pins 56 will align with active holes 48a, 48b. As a result, if jaws 46a, 46b subsequently are opened and pins 56 contact stopping wall 60 and are inserted through active holes 48a, 48b, jaws 46a, 46b will be locked in their open position.

To lower sampling tube 10 into auger 28, pins 56 are pulled downward in FIG. 4 such that they do not extend to split ring 42. Release and retrieve assembly 14 is placed on locking mechanism 12 with hold and release head 44 and split ring 42 just below lift head cone 36. Hold and release head 44 is rotated to the detented release position, i.e., such that pins 56 are aligned, but still below, the location of active holes 48a, 48b when jaws 46a, 46b are opened. It is important to note that at this time jaws 46a, 46b are in the closed position of FIG. 5A because split ring 42 is spring-biased by four pins 72 and four jaw springs 52 toward the closed position. The expanding diameter of lift head cone 36 temporarily opens jaws 46a, 46b to facilitate the positioning of hold and release head 44 below lift head cone 36. Once jaws 46a, 46b are below lift head cone 36 they spring back to their closed position by means of jaw springs 52.

Sampling tube 10, locking mechanism 12 and release and retrieve assembly 14 are lowered by the wire line down inside the hollow bore of auger 28 as a unit. At this point, there is a gap between pin guide 24 and connector 84 because locking pins 68 are constrained by the interior wall of auger 28. Thus, spring 32 is compressed. When bearing housing 86 bottoms out on stopping shoulder 118 of housing 100, locking mechanism 12 stops moving. In the embodiment that eliminates bearing assembly 83, body 92 bottoms out on stopping shoulder 118. When locking mechanism 12 stops moving, spring 32 expands, thereby allowing pin guide 24 to move down closer to connector 84. The downward movement of pin guide 24 causes axial movement of locking pins 68. This axial movement of locking pins 68 into the larger diameter portion of pin guide 24 pushes end 115 of locking pins 68 radially outward and into groove 30 of housing 100. This extension of locking pins 68 into groove 30 fixes the position of locking mechanism 12 and sampling tube with respect to auger 28. At this point, start tube 76 extends below drill bits 16 by the predetermined amount set via adjustment shaft 18.

When sampling tube 10 and locking mechanism 12 are stabilized, lift head cone 36 and release head cone 38 are similarly incapable of further vertical movement. At this instant, split ring 42 and hold and release head 44 still are located between lift head cone 36 and release head cone 38. The release and retrieve assembly 14 continues to fall.

Because release head cone 38 stops moving and release and retrieve assembly 14 continues to descend, jaws 46a, 46b contact release head cone 38. The expanding diameter of release head cone 38 opens jaws 46a, 46b as release and retrieve assembly 4 continues to fall. As jaws 46a, 46b approach the largest diameter portion of release head cone 38, pins 56 bottom out on the surface of stopping wall 60. As the rest of release and retrieve assembly 14 continues descending, pins 56 are moved upwardly into active holes 48a, 48b thereby locking jaws 46a, 46b in their open position. Release and retrieve assembly 4 stops moving when hold and release head 44 bottoms out. At this point, jaws 46a, 46b surround the cylindrical lower portion of release head cone 38.

By using a hoist to raise the wire line, release and retrieve assembly 14 is lifted out from auger 28. Because split ring 42 is in the open position, jaws 46a, 46b do not contact the conical portion of release head cone 38 or any portion of lift head cone 36 as assembly 14 is lifted upward. After release and retrieve assembly 14 is removed, auger 28 is drilled farther into the ground and sampling tube 10 fills with soil.

After the auger 28 has drilled a distance equal to the length of sampling tube 10, release and retrieve assembly 14 is used to retrieve sampling tube 10 from auger 28. Pins 56 are pulled downward out from assembly 14 to allow jaws 46a, 46b to return to their closed position. Hold and release head 44 is rotated 90° from the position used for lowering sampling tube 10 down inside auger 28. Thus, hold and release head 44 is now in its hold position and pins 56 are aligned with passive holes 50a, 50b.

Figure 8:
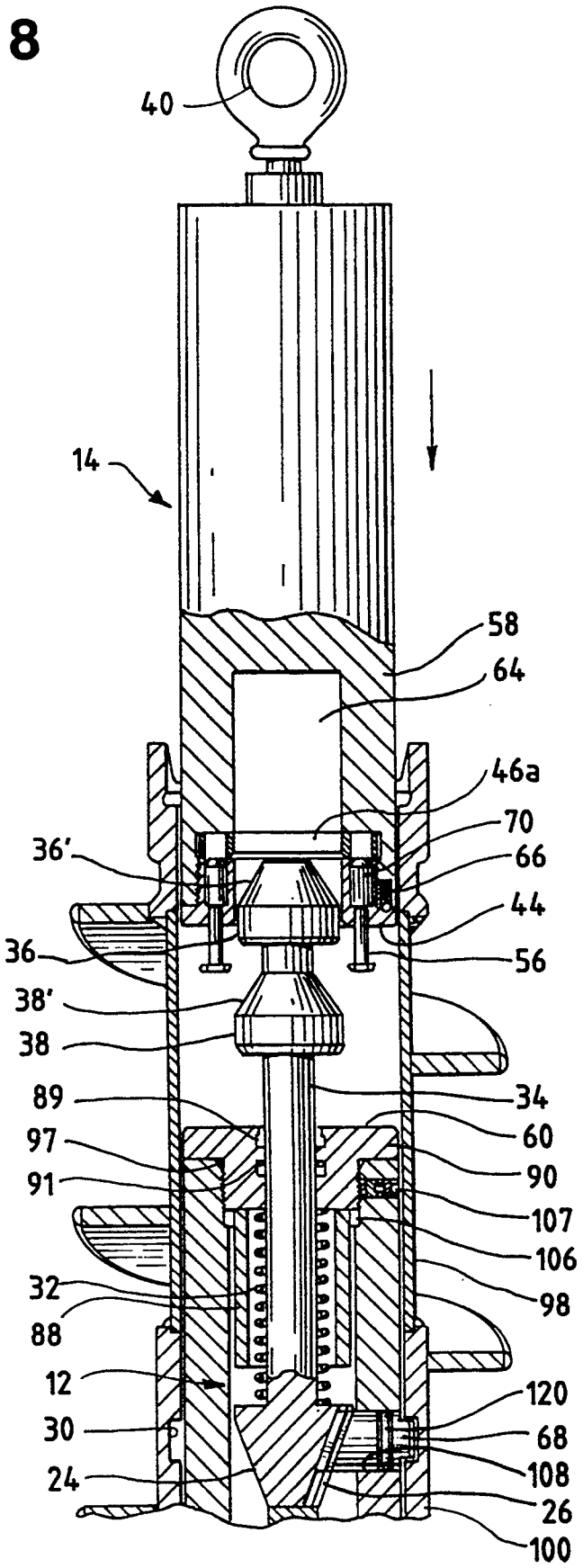
FIG. 8 is a cross section view of the sampling system of the present invention with the release and retrieve assembly descending over the locking mechanism.

Release and retrieve assembly 14 is lowered into auger 28 via the wire line as shown in FIG. 8. For simplification, lift head cone 36 and release head cone 38 are not shown in cross-section in FIG. 8. As release and retrieve assembly 14 passes over lift head cone 36, jaws 46a, 46b are forced outward. This allows jaws 46a, 46b to pass over lift head cone 36. Once past lift head cone 36, however, the spring-biased jaws 46a, 46b snap closed via jaw springs 52. As jaws 46a, 46b pass over release head cone 38, jaws 46a, 46b are again forced open. When pins 56 bottom out on stopping wall 60, pins 56 are pushed upward relative to the rest of release and retrieve assembly 14. Pins 56 therefore pass through passive holes 50a, 50b. Hold and release head 44 then bottoms out.

Figure 9:
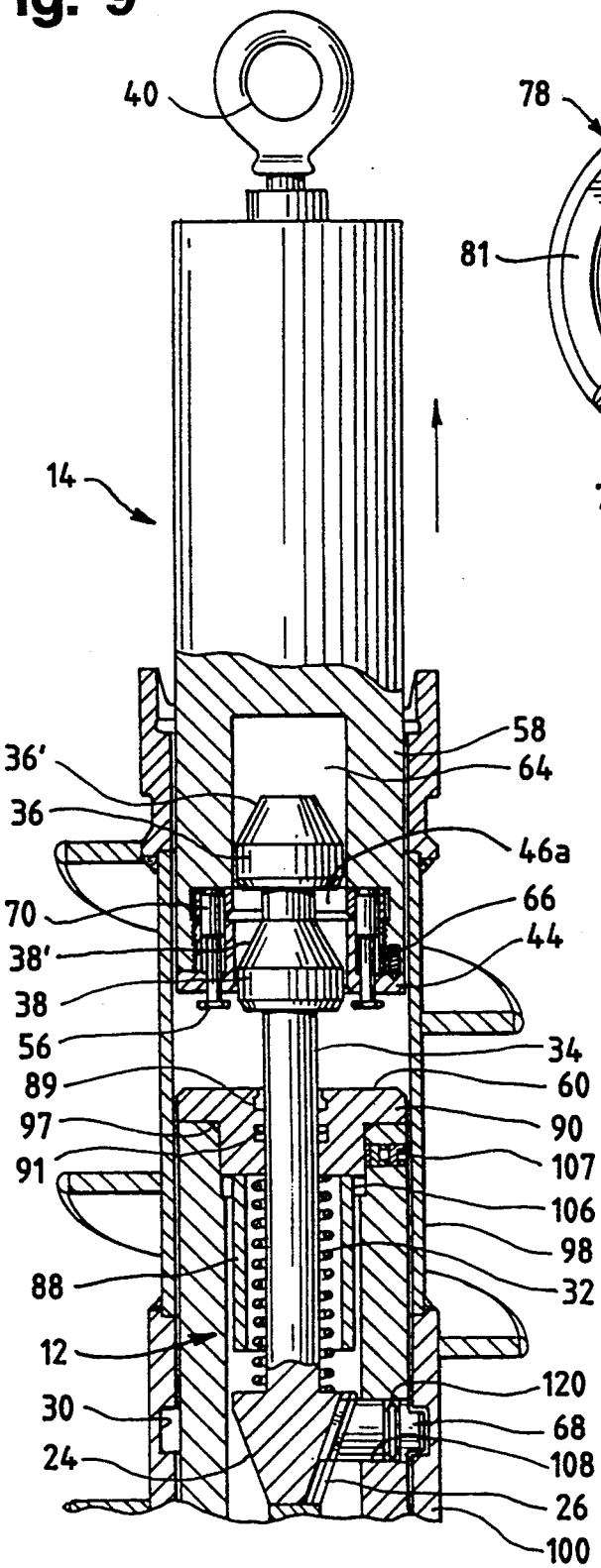
FIG. 9 is a cross-section view of the sampling system of the present invention with the release and retrieve assembly holding the locking mechanism just before the locking mechanism and attached sampling tube are going to be raised.

At this point, jaws 46a, 46b are in their open position and are surrounding the lower portion of release head cone 38. Pins 56 are in the location of passive holes 50a, 50b, although passive holes 50a, 50b are not formed at this time because jaws 46a, 46b are in their opened position. The hoist raises the wire line and begins lifting release and retrieve assembly 14. As release and retrieve assembly 14 is raised, jaws 46a, 46b close in between lift head cone 36 and release head cone 38. Now passive holes 50a, 50b are formed around pins 56. Release and retrieve assembly 14 is now as shown in FIG. 9. For simplification, lift head cone 36 and release head cone 38 are not shown in cross-section in FIG. 9. Because jaws 46a, 46b are closed, jaws 46a, 46b "grab" just below lift head cone 36. The lifting force in combination with the weight of sampling tube 10 causes pin guide 24 to ascend and spring 32 to compress. This lifting forces locking pins 68 down to the narrow end of pin guide 24 and locking pins 68 are withdrawn from groove 30. As pin guide 24 rises, pin guide 24 contacts guide stop 88 which then also rises causing the entire locking mechanism 12 and sampling tube 10 to be lifted as a unit from auger 28.

Once the apparatus is removed from auger 28, release and retrieve assembly 14 is removed from locking mechanism 12. Pins 56 are pulled downward and hold and release head 44 is rotated to the release position. By lowering sampling tube 10 onto a flat surface, e.g., the ground, pins 56 are inserted through active holes 48a, 48b thereby locking jaws 46a, 46b in their open position. Release and retrieve assembly 14 is raised to disengage locking mechanism 12. Sampling tube 10 is disengaged by separating coupler 102 (see FIG. 1). At this point, a new sampling tube 10 can be attached via coupler 102 and another sample taken by repeating the foregoing process. Alternatively, the sample can be removed, sampling tube 10 decontaminated and then reinserted into auger 28.

When the sampling process is begun at the same time as the drilling of the well, sampling tube 10 can be placed ahead of drill bits 16. If, on the other hand, the first sample is taken at a depth below the surface of the ground, auger 28 may be inserted to that depth and then backed out several inches to provide a space below bits 16 for the protruding sampling tube 10. Subsequently, each new sampling tube 10 is lowered into auger 28 and it falls to a position below drill bits because of the space in the soil vacated by removal of the previous sampling tube 10.

Because there is no time-consuming assembly and disassembly of a center rod, successive samples can be taken more quickly and efficiently than was previously possible. Moreover, when sampling tube is placed ahead of drill bits 16 when the sample is taken, contamination of the sample is reduced or eliminated.

Whereas the present invention has been described with respect to specific embodiments thereof, it will be understood that various changes and modifications will be suggested to one skilled in the art and it is intended that the invention encompass such changes and modifications as fall within the scope of the appended claims.

What is claimed is:

1. A sampling apparatus for use within a tube, comprising:

sampling means for taking a sample;

locking means attached to said sampling means for selectively preventing axial movement of said sampling means with respect to the tube; and release and retrieval means capable of engaging and disengaging said locking means for raising and lowering said locking means within the tube, said release and retrieval means further comprising:

a hold and release head defining a plurality of holes;

a plurality of pins housed in said holes; and a split ring attached to said hold and release head, said split ring including plurality of jaws and defining a plurality of openings for receiving said pins, wherein said pins selectively maintain said jaws in a predetermined position.

2. The sampling apparatus of claim 1 wherein said hold and release head is selectively adjustable into a hold position in which said jaws move free of said pins and a release position in which said pins maintain said jaws in a predetermined position when said pins move into said plurality of openings.

3. The sampling apparatus of claim 2 wherein said release and retrieval means further comprises a release and retrieve body having a hollow portion, said body being attached to said hold and release head such that said hold and release head is rotatable with respect to said release and retrieve body.

4. The sampling apparatus of claim 1 wherein said jaws are movable into an open position in which said jaws are spaced apart from each other and a closed position in which said jaws are in contact with each other.

5. The sampling apparatus of claim 4 including biasing means for biasing said jaws toward said closed position.

6. The sampling apparatus of claim 5 wherein said biasing means comprises at least one spring.

7. The sampling apparatus of claim 6 wherein said biasing means includes four springs.

8. The sampling apparatus of claim 4 wherein each of said jaws defines an active hole for receiving one of said pins and locking said jaw in said open position.

9. The sampling apparatus of claim 8 wherein said jaws define a plurality of passive holes for receiving said pins.

10. The sampling apparatus of claim 1 wherein said sampling means comprises a sampling tube.

11. The sampling apparatus of claim 10 wherein said sampling tube is made of stainless steel.

12. The sampling apparatus of claim 10 further comprising a tube in which the sampling apparatus is inserted, said tube having drilling means having at least one drill bit for drilling through soil and wherein said sampling tube protrudes beyond the drill bit.

13. The sampling apparatus of claim 12 wherein said sampling tube includes adjustment means for adjusting how far said sampling tube protrudes beyond the drill bit.

14. The sampling apparatus of claim 13 wherein said adjustment means comprises a threaded adjustment shaft coupled to said sampling tube.

15. The sampling apparatus of claim 11 wherein said sampling tube includes a liner.

16. The sampling apparatus of claim 1 further comprising a tube in which the sampling apparatus is inserted, said tube having a stopping member for engaging said locking means.

17. The sampling apparatus of claim 16 wherein said tube has an inner wall defining at least one receptacle and wherein said locking means further comprises:

stopping means for engaging the stopping member;

a locking member having at least one locking pin for insertion into the at least one receptacle;

a shaft extending upwardly from said locking member;

a lift head spaced axially away from said locking member;

a release head located on said shaft between said lift head and said locking member; and a stopping surface located adjacent said shaft between said release head and said locking member.

18. The sampling apparatus of claim 2 further comprising a mechanism for selectively maintaining said hold and release head in the hold position and the release position.

19. A sampling apparatus for use within a tube having a stopping member and at least one receptacle in its interior and drilling means for drilling through soil, comprising:

sampling means for taking a sample;

locking means attached to said sampling means for selectively preventing axial movement of said sampling means with respect to the tube;

release and retrieval means capable of engaging and disengaging said locking means for raising and lowering said locking means within the tube;

wherein said locking means further comprises stopping means for engaging the stopping member;

a locking member having at least one locking pin for inserting into the at least one receptacle;

a shaft extending upwardly from said locking member;

a lift head spaced axially away from said locking member;

a release head located on said shaft between said lift head and said locking member; and a stopping surface located adjacent said shaft and between said release head and said locking member.

20. The sampling apparatus of claim 19 wherein said locking member is cone-shaped.

21. The sampling apparatus of claim 20 wherein said at least one locking pin is a T-pin.

22. The sampling apparatus of claim 21 including a T-pin guide and a spring located around said shaft such that when said spring is extended, said at least one T-pin is inserted into the at least one receptacle and when said spring is compressed said at least one T-pin is withdrawn from the at least one receptacle.

23. The sampling apparatus of claim 19 wherein said lift head has an upper portion and a lower portion, said upper portion being wider at its lower end than its upper end and said lower portion having a constant width equal to the width of the lower end of said upper portion.

24. The sampling apparatus of claim 23 wherein said release head has an upper portion and a lower portion, said upper portion being wider at its lower end than its upper end and said lower portion having a constant width equal to the width of the lower end of said upper portion.

25. The sampling apparatus of claim 24 wherein said lower portion of said release head is wider than said lower portion of said lift head.

26. The sampling apparatus of claim 17 wherein the at least one receptacle comprises a circumferential groove.

27. A method for taking a soil sample, comprising the steps of:

(a) inserting a sampling tube into an auger embedded in the soil using a wire line and a retrievable assembly, the retrievable assembly comprising locking means attached to the sampling tube for selectively preventing axial movement of the sampling tube with respect to the auger and release and retrieval means capable of engaging and disengaging the locking means for raising and lowering the locking means within the auger, wherein the release and retrieval means comprises:

a hold and release head defining a plurality of holes;

a plurality of pins housed in the holes; and a split ring attached to the hold and release head and including a plurality of jaws, the split ring defining a plurality of openings for receiving the pins, wherein the pins selectively maintain the jaws in a predetermined position;

(b) removing the retrievable assembly from the auger;

(c) causing a sample of material to enter the sampling tube;

(b) reinserting the retrievable assembly using the wire line; and (e) removing the sampling tube from the auger.

28. A method for taking soil samples, comprising the steps of:

(a) inserting a sampling tube into an auger having drill bit on the bottom end thereof using a wire line and a retrievable assembly, such that the sampling tube protrudes below the drill bit, the retrievable assembly comprising locking means attached to the sampling tube for selectively preventing axial movement of the sampling tube with respect to the auger and release and retrieval means capable of engaging and disengaging the locking means for raising and lowering the locking means within the auger, wherein the release and retrieval means comprises:

a hold and release head defining a plurality of holes;

a plurality of pins housed in the holes;and a split ring attached to the hod and release head and including a plurality of jaws, the split ring defining a plurality of openings for receiving the pins, wherein he pins selectively maintain the jaws in a predetermined position;

(b) removing the retrievable assembly from the auger;

(c) causing a sample of material to enter the sampling tube;

(d) reinserting the retrievable assembly using the wire line; and (e) removing the sampling tube from the auger, thereby leaving a space in the soil below the drill bit.

29. The method of claim 28 further comprising the step of inserting a new sampling tube into said auger using said wire line and said retrievable assembly, such that said new sampling tube fills said space.

30. The method of claim 29 wherein said step of inserting a new sampling tube comprises removing the sample from the sampling tube and then re-inserting the sampling tube.

31. A method for taking a soil sample, comprising the steps of:

(a) inserting a sampling tube into an auger imbedded in the soil using a wire line and a retrievable assembly, the auger having a stopping member and at least one receptacle in its interior and the retrievable assembly comprising locking means attached to the sampling tube for selectively preventing axial movement of the sampling tube with respect to the auger and release and retrieval means capable of engaging and disengaging the locking means for raising and lowering the locking means within the auger, wherein the locking means comprises:

stopping means for engaging the stopping member;

a locking member having at least one locking pin for insertion into the at least one receptacle;

a shaft extending upwardly from the locking member;

a lift head spaced axially away from the locking member;

a release head located on the shaft between the lift head and the locking member; and a stopping surface located adjacent the shaft and between the release head and the locking member;

(b) removing the retrievable assembly from the auger;

(c) causing a sample of material to enter the sampling tube;

(d) reinserting the retrievable assembly using the wire line; and (e) removing the sampling tube from the auger.

* * * * *